US012133598B2

(12) United States Patent
Gueye

(10) Patent No.: US 12,133,598 B2
(45) Date of Patent: Nov. 5, 2024

(54) HAIR EXTENSION HOLDER

(71) Applicant: Aissatou Thiam Gueye, Fort Worth, TX (US)

(72) Inventor: Aissatou Thiam Gueye, Fort Worth, TX (US)

( * ) Notice: Subject to any disclaimer, the term of this patent is extended or adjusted under 35 U.S.C. 154(b) by 0 days.

(21) Appl. No.: 18/623,902

(22) Filed: Apr. 1, 2024

(65) Prior Publication Data

US 2024/0324796 A1 Oct. 3, 2024

Related U.S. Application Data

(60) Provisional application No. 63/493,635, filed on Mar. 31, 2023.

(51) Int. Cl.
*A47F 7/06* (2006.01)
*A45D 44/04* (2006.01)

(52) U.S. Cl.
CPC ..... *A47F 7/065* (2013.01); *A45D 44/04* (2013.01)

(58) Field of Classification Search
CPC ... A47F 7/065; A47F 7/12; A47F 7/10; A47G 25/74; A45D 44/04
See application file for complete search history.

(56) References Cited

U.S. PATENT DOCUMENTS 1,402,635 A * 1/1922 Meyer ..... G09F 5/042 206/466
1,477,241 A * 12/1923 Carson ..... G09F 5/042 206/372
1,579,720 A * 4/1926 Lerner ..... A47F 7/12 248/450
1,785,498 A * 12/1930 Savageau ..... B65D 33/00 206/466
1,940,078 A * 12/1933 Simon ..... B65D 33/02 206/466
2,030,996 A * 2/1936 Lustig ..... G09F 5/042 206/466
2,043,070 A * 6/1936 Rutkowski ..... B65D 73/0021 211/75
2,294,527 A * 9/1942 Weiss ..... A47G 25/74 24/336

(Continued)

FOREIGN PATENT DOCUMENTS

CH 208262 A * 1/1940
DE 452199 C * 11/1927

(Continued)

*Primary Examiner* — Stanton L Krycinski

(57) ABSTRACT

The device is a hair extension holder capable of separating and holding individual hair pieces on a display board. The display board comprises a plurality of retainers shaped in the form of a "V" and a "Λ", positioned within rows of cutouts. Each V and Λ shape traverse across each row in a staggered pattern, positioned one after another, in a VΛVΛV pattern. In this arrangement, each V and Λ shape function as a retainer, allowing the user to bend the retainer outward and hang each hair piece on the display board. Furthermore, the unique pattern of retainers allows the user to flip the display board around and use the same retainers on the front side to hold separate hair pieces on the back side. When starting the braiding process, the user simply pulls a hair piece out of the retainer, one at a time, and begins braiding.

6 Claims, 6 Drawing Sheets

(56) References Cited

U.S. PATENT DOCUMENTS 2,358,295 A * 9/1944 Bacigalupi ..... B65D 5/5038 206/488
2,457,274 A * 12/1948 Rifken ..... A47K 10/14 248/314
2,608,292 A * 8/1952 Stensgaard ..... A47F 7/12 229/87.01
2,783,880 A * 3/1957 Kayton ..... A47F 7/10 434/398
2,793,762 A * 5/1957 Mayo ..... D06F 57/00 211/89.01
3,028,013 A * 4/1962 Cotey ..... A47G 25/74 211/85.3
3,040,881 A * 6/1962 McNeill ..... A47F 7/021 206/5
3,046,711 A * 7/1962 Harrison ..... B65D 71/44 53/48.5
3,081,881 A * 3/1963 Seeger ..... A47G 25/743 211/85.3
3,228,518 A * 1/1966 Coby ..... B65D 5/5038 206/562
3,705,653 A * 12/1972 Pereyra ..... A47G 25/74 211/85.3
4,312,449 A * 1/1982 Kinderman ..... A47F 5/0884 206/466
4,420,084 A * 12/1983 Whelan ..... A47F 7/02 211/85.2
4,422,552 A * 12/1983 Palmer ..... B65D 73/0021 206/466
4,651,873 A * 3/1987 Stolcenberg ..... B65D 71/50 206/427
4,667,827 A * 5/1987 Calcerano ..... B65D 73/0021 206/483
5,096,070 A * 3/1992 Jaynes ..... A47F 5/0006 211/85.15
5,103,970 A * 4/1992 Nielson ..... B65D 73/00 206/45.24
5,199,578 A * 4/1993 Pendergraph ..... A47F 5/0006 211/113
5,284,259 A * 2/1994 Conway ..... A47F 5/0006 248/225.11
5,339,967 A * 8/1994 Valiulis ..... A47F 5/0006 211/113
5,386,916 A * 2/1995 Valiulis ..... A47F 5/0056 211/113
5,405,022 A * 4/1995 Rissley ..... A47F 5/0006 211/113
5,553,721 A * 9/1996 Gebka ..... A47F 5/0006 211/113
5,667,081 A * 9/1997 Pund-Hogan ..... B07C 7/02 211/10
5,743,403 A * 4/1998 Crysdale ..... B65D 73/0021 211/113
5,762,212 A * 6/1998 Pomerantz ..... A47F 5/0006 211/113
6,029,829 A * 2/2000 Ovadia ..... B65D 73/0042 211/85.2
D436,727 S * 1/2001 Hsu ..... D3/903
6,769,555 B2 * 8/2004 Brady ..... A47G 25/743 211/89.01
6,866,143 B2 * 3/2005 Ovadia ..... A47F 7/02 206/6.1
7,467,720 B2 * 12/2008 Williquette ..... A47F 5/0884 211/13.1
D601,798 S * 10/2009 Hsu ..... D3/903
8,998,002 B1 4/2015 Milner
9,332,820 B2 * 5/2016 Bernard ..... A45D 44/02
9,630,828 B1 * 4/2017 Gardner ..... G01F 11/00
10,786,059 B1 * 9/2020 DoCouto ..... A45D 44/04
D918,057 S * 5/2021 L'Heureux ..... D9/752
11,124,341 B2 * 9/2021 Patton ..... B65D 71/504
11,510,448 B2 11/2022 Adams
11,608,225 B2 * 3/2023 Manninen ..... B65F 1/0033
2003/0146178 A1 * 8/2003 Brady ..... A47G 25/74 211/89.01
2003/0234185 A1 * 12/2003 Flagg ..... A45C 11/16 211/85.2
2013/0048006 A1 2/2013 Springfield-Thomas

FOREIGN PATENT DOCUMENTS

DE 838855 C * 5/1952
FR 35567 E * 3/1930
FR 2802399 A1 * 6/2001 ..... A47F 5/112
GB 286235 A * 3/1928
GB 506482 A * 5/1939

* cited by examiner

HAIR EXTENSION HOLDER

FIELD OF THE INVENTION

The present invention relates generally to beauty accessories. More specifically, the present invention is an improved hair extension holder designed to hold multiple strands of hair pieces on a wall-mounted display board.

BACKGROUND OF THE INVENTION

Hair extensions are used to add length and volume to a person's own hair. There are various techniques used in braiding hair extensions. Before starting the braiding process, professional hair braiders (users) need time to prepare the hair by separating it into multiple small pieces. It is necessary to divide the hair pieces away from one another so that they do not become entangled. As such, the preparation process before braiding can be tedious and time consuming.

Recently, manufacturers have attempted to solve the issue by providing hair extension holders. These holders separate each hair piece, thereby preventing them from becoming entangled. One such device uses a display stand mounted on a wheeled base with leg extensions. The rollers allow the user to move the device from one place to the next. Another similar product holds hair extensions on a rack mounted to a fold-out stand. Although these products help with separating the hair pieces, they provide minimal benefit because they take time to set up and occupy a large amount of space.

An objective of the present invention is to provide a solution to the aforementioned problems. More specifically, it is an aim of the present invention to provide a hair extension holder that not only separates the hair pieces, but is also more compact and easier to use. Preferably, the device can be purchased as a pre-packaged item, having the hair pieces already divided. The device includes a board having a unique pattern of cutouts that function as holders for each of the hair pieces. Both the front and back sides can be used to hold the hair pieces, and the board itself easily mounts to a wall near the hair braider's workstation. Unlike the other products mentioned above, this device is ready to use immediately upon opening and takes up very little space. When starting the braiding process, the user simply pulls a hair piece out of the holder, one at a time, and begins braiding.

SUMMARY OF THE INVENTION

The present invention is a hair extension holder capable of separating and holding individual hair pieces on a display board. The device comprises a plurality of retainers in the form of cutouts arranged in rows. Each retainer holds a hair piece and both sides of the board can be used to hang individual hair pieces. The device further comprises a mounting hole which can be used to attach the board to any wall near the user's workstation. The device can be pre-packaged with hair pieces already included, requiring little to no time to set up. When starting the braiding process, the user simply pulls a hair piece out of the retainer, one at a time, and begins braiding.

DETAIL DESCRIPTIONS OF THE INVENTION

All illustrations of the drawings are for the purpose of describing selected versions of the present invention and are not intended to limit the scope of the present invention.

Figure 1:
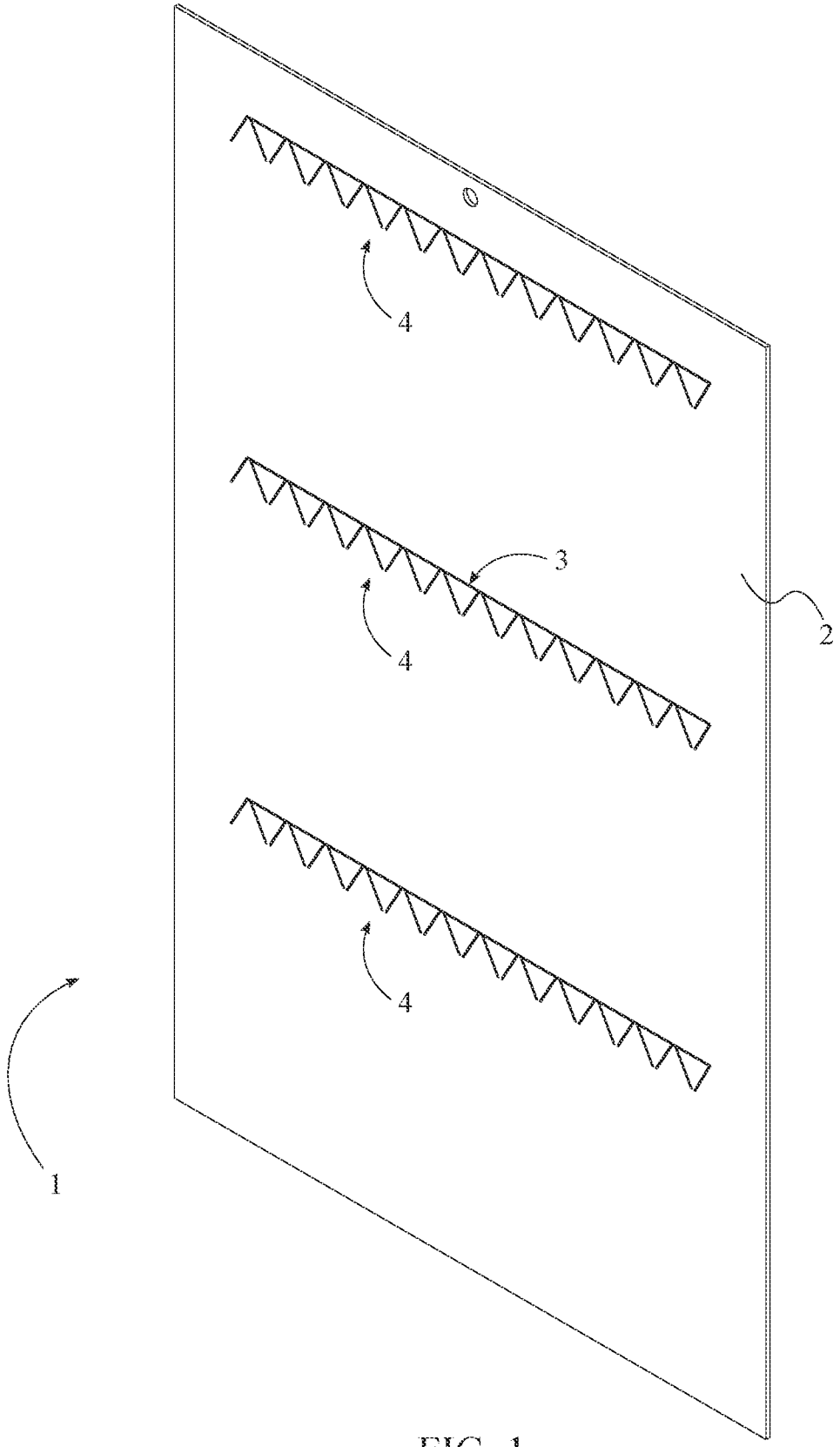
FIG. 1 is a front perspective view of the present invention.
Figure 2:
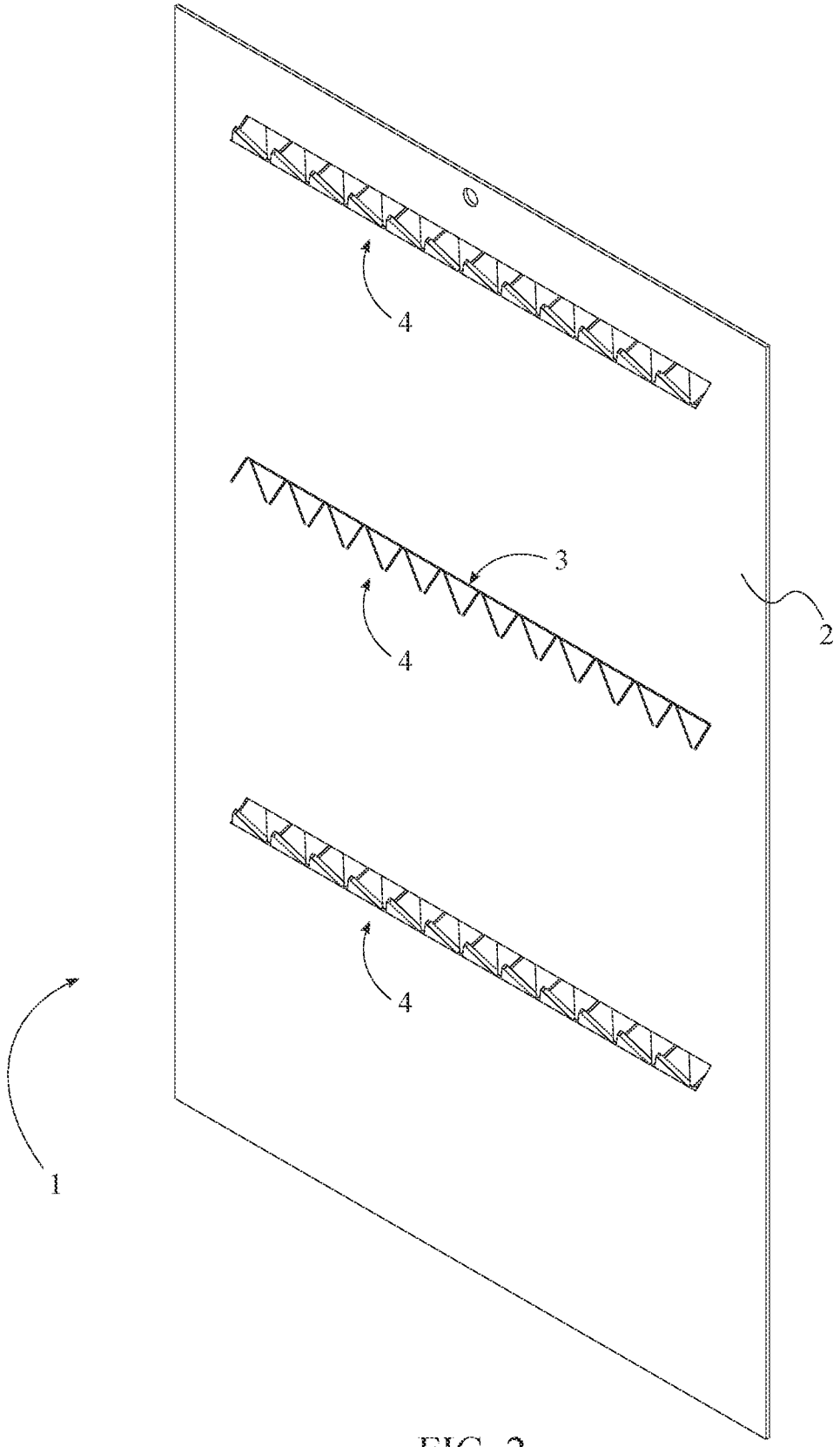
FIG. 2 is a front perspective view of the present invention, showing the retainers in an open position.
Figure 3:
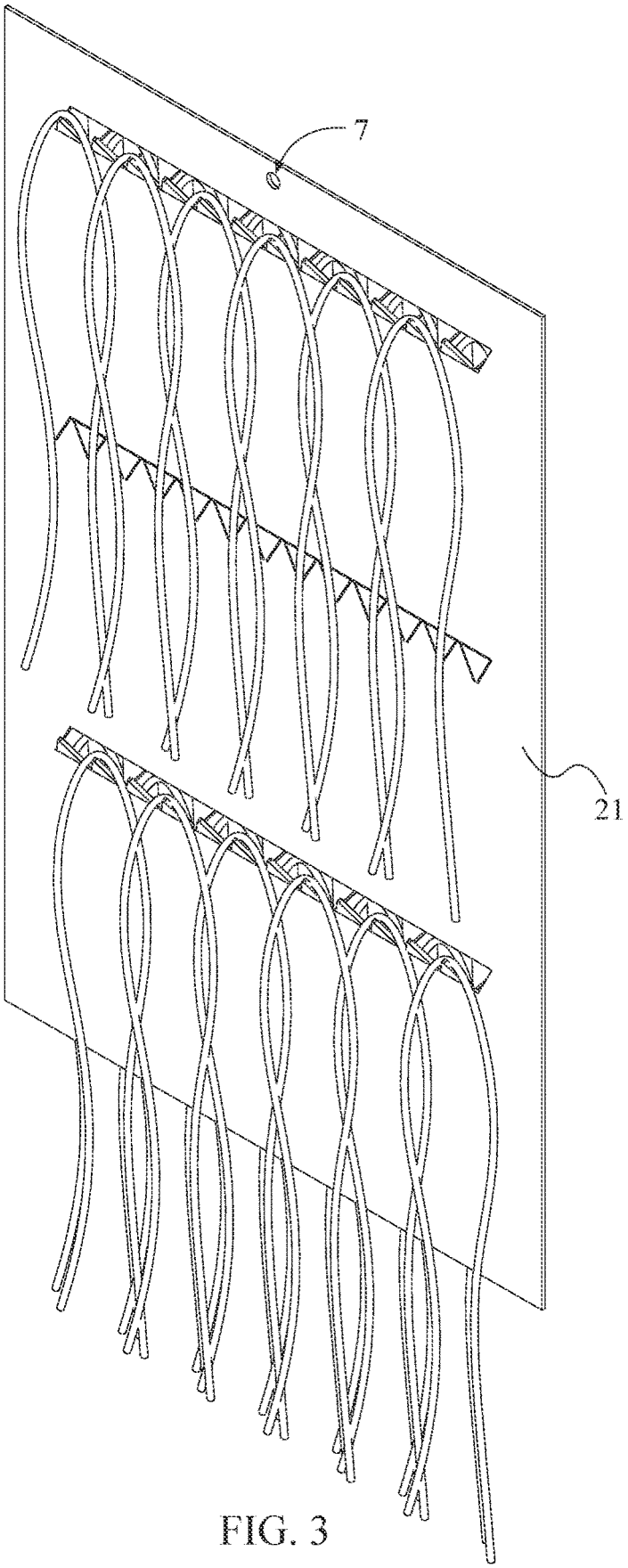
FIG. 3 is a front perspective view of the present invention, showing hair pieces attached.
Figure 4:
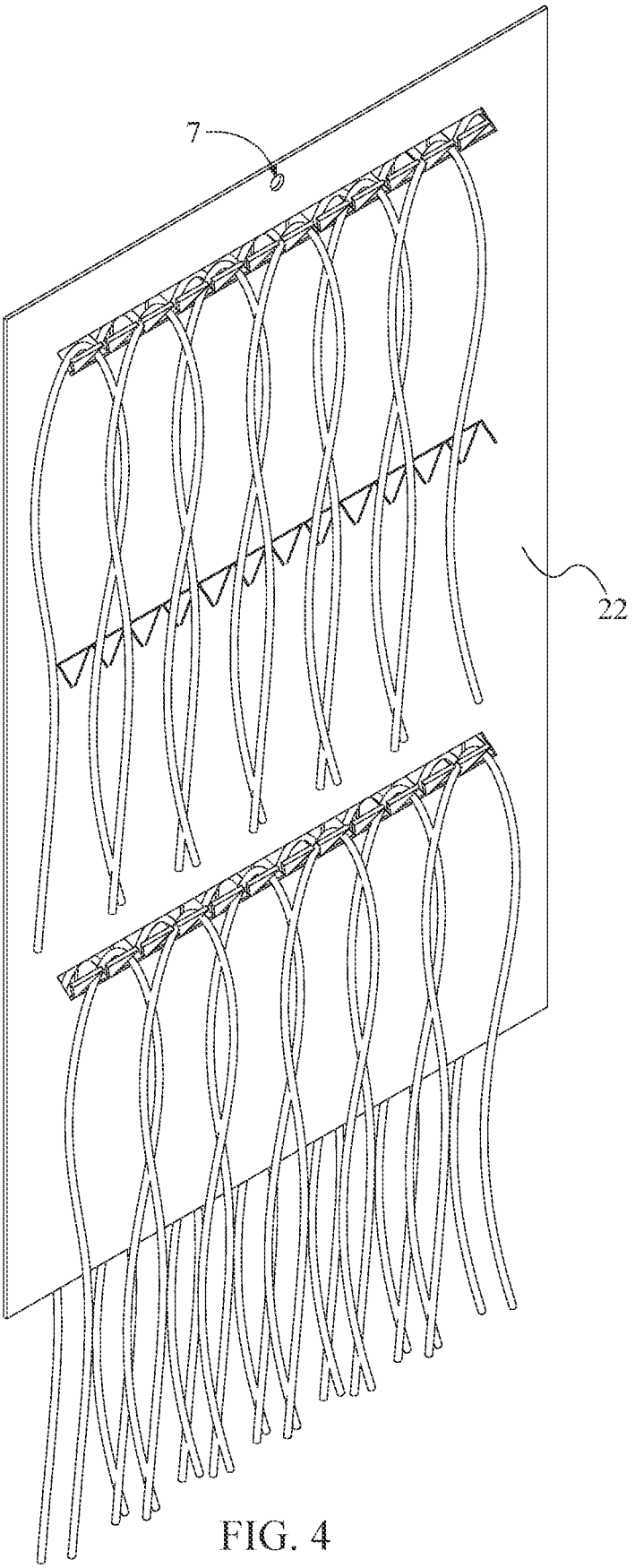
FIG. 4 is a rear perspective view of the present invention, showing hair pieces attached.

In reference to FIG. 1 through FIG. 6, the present invention is a hair extension holder 1. More specifically, the present invention is a hair extension holder 1 that is designed to separate and hold individual hair pieces. The device makes it easier for hair braiders (users) to prepare the hair before starting the hair braiding process. The user first prepares the hair extension holder 1 by hanging the desired hair pieces on each of the plurality of retainers 4. In a preferred embodiment, as seen in FIG. 3, the present invention is pre-packaged with the hair pieces already attached in the retainers 4. As seen in FIG. 4, the device can be flipped around to the rear side 22 to hang more hair pieces, using the same retainers 4 from the front side 21. After the hair extension holder 1 is fully prepared, the user can hang the device on a wall near the user's workstation. When ready to use, the user simply pulls each hair piece out through the retainer, one after another. The user can also select hair pieces from the rear side 22 by first, detaching the panel board 2 from the wall; second, rotating the panel board 2 around so that the rear side 22 is now facing the user; and third, reattaching the panel board 2 back to the wall.

The present invention comprises a panel board 2 having a predefined length and width. Preferably, the panel board 2 is made from laminated paperboard. However, it is understood that the material of the panel board 2 is not limited and can be manufactured in any suitable material based on design, user, and/or manufacturing requirements. The panel board 2 further comprises a front side 21, a rear side 22, at least one cutout 3, and a plurality of retainers 4. As best seen in FIGS. 1-2, the at least one cutout 3 is disposed on the front side 21, traversing through the rear side 22. The plurality of retainers 4 are positioned within the at least one cutout 3. In the preferred embodiment, the panel board 2 comprises more than one cutout 3, wherein each cutout 3 traverses laterally across the panel board 2 in a series of rows. As seen in FIGS. 3-4, having multiple rows of cutouts 3 and retainers 4 gives the user a greater selection of hair pieces to choose from.

Figure 5:
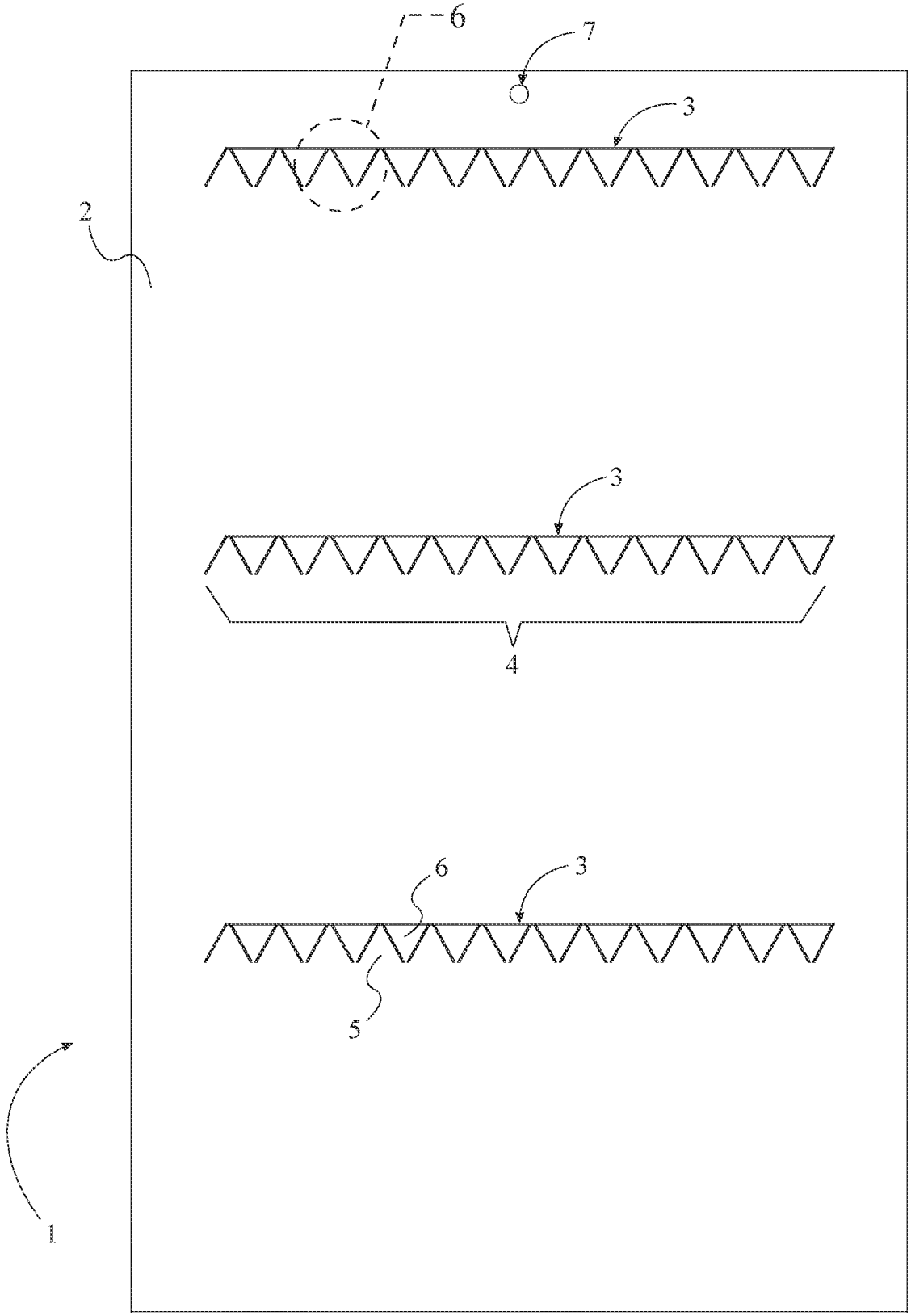
FIG. 5 is a front elevational view of the present invention.

In order to hang the individual hair pieces, each retainer is integrated into the panel board 2. As best seen in FIG. 5, each retainer 4 is formed by a series of cuts in the shape of an upright "V" (V) and upside-down "V" (Λ). In the preferred embodiment, each V and Λ shape traverse across each row in a staggered pattern, positioned one after another. In other words, each V is positioned adjacent to each Λ in a VΛVΛV pattern. For each V and Λ shape, only the bottom portion is retained. The remaining sides are trimmed off. In this arrangement, both the V and Λ shape function as a retainer, allowing the user to bend the retainer outward and hang each hair piece within the untrimmed portion. Furthermore, the unique pattern of cuts allows the user to flip the panel board 2 around and use the same retainers 4 on the front side 21 to hold separate hair pieces on the back side 22.

Figure 6:
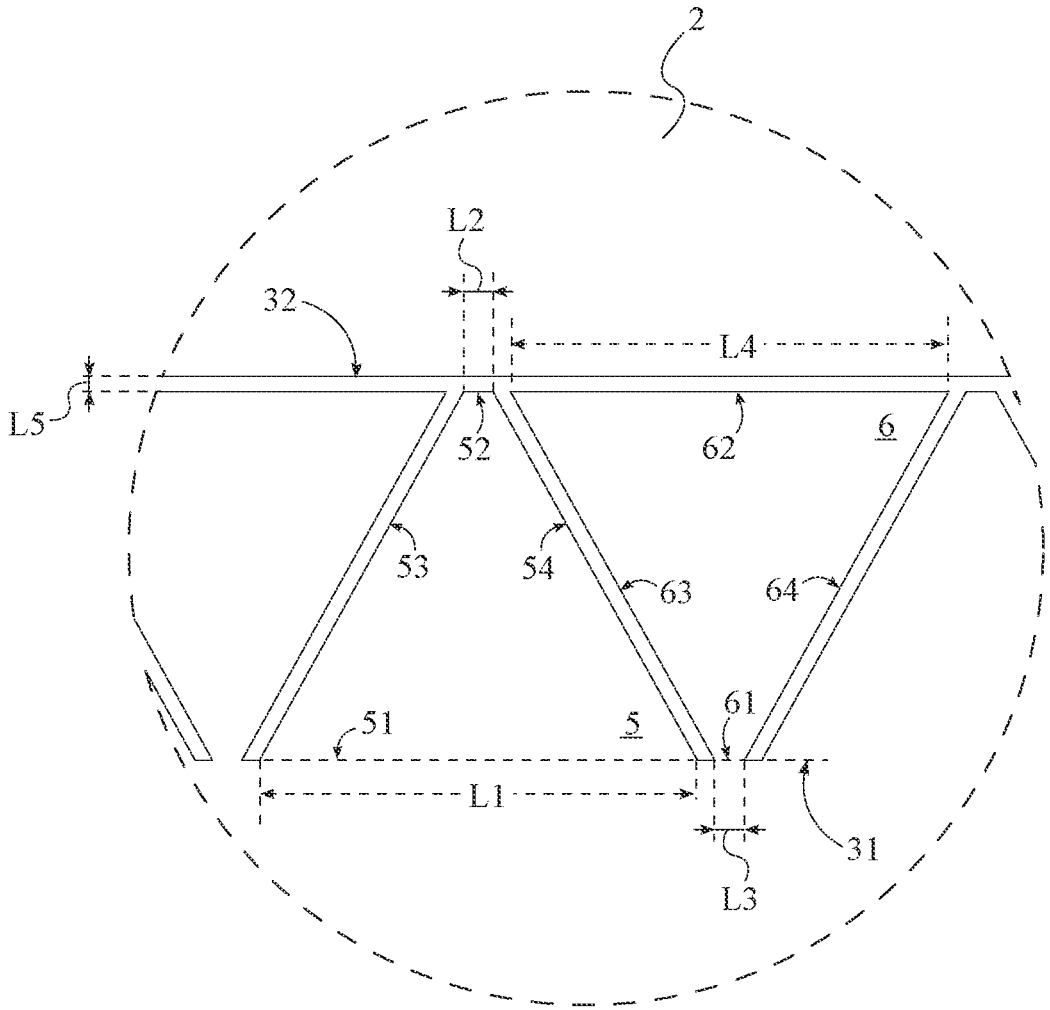
FIG. 6 is a magnified view taken from FIG. 5, showing the retainers.

In reference to FIG. 6, the plurality of retainers 4 comprises at least one first retainer 5 and at least one second retainer 6. The at least one first retainer 5 further comprises a base 51, a top side 52, a left side 53, and a right side 54. Similarly, the at least one second retainer 6 further comprises a base 61, a top side 62, a left side 63, and a right side 64. The base 51 of the first retainer 5 and the base 61 of the second retainer 6 are each terminally connected to a bottom edge 31 of the at least one cutout 3. The top side 52 of the first retainer 5 and the top side 62 of the second retainer 6 are each offset from a top edge 32 of the at least one cutout 3 by a predefined gap L5.

Regarding position, the right side 54 of the at least one first retainer 5 is positioned adjacent to the left side 63 of the at least one second retainer 6. Regarding shape, a base width L1 of the at least one first retainer 5 is greater than a top side width L2 of the at least one first retainer. Conversely, a base width L3 of the at least one second retainer 6 is less than a top side width L4 of the at least one second retainer.

In order to form the continuous VΛVΛV pattern described above, the at least one first retainer 5 is V-shaped, tapering upward, and the at least one second retainer 6 is V-shaped, tapering downward. More specifically, the base width L1 of the first retainer 5 is equal to the top side width L4 of the second retainer 6, and the base width L3 of the second retainer 6 is equal to the top side width L2 of the first retainer 5.

In order to hang the hair extension holder 1 on a wall, the panel board 2 further comprises a mounting hole 7 positioned near the top. More specifically, the mounting hole 7 is disposed on the front side 21, traversing through the rear side 22 of the panel board 2. This arrangement allows the user to mount the panel board 2 in a convenient location near a work station. To access hair pieces on the rear side 22, the user can flip the panel board 2 around and reattach the panel board 2 back to the wall. It is understood that the means of attachment is not limited to a mounting hole 7. Thus, the hair extension holder 1 can utilize other conventional means of attachment, including but not limited to hook and loop fasteners, button snaps, and mounting clips.

Although the invention has been explained in relation to its preferred embodiment, it is to be understood that many other possible modifications and variations can be made without departing from the spirit and scope of the invention.

What is claimed is:

1. A hair extension holder comprising:

a panel board;

the panel board comprising a front side, a rear side, at least one cutout, and a plurality of retainers;

the at least one cutout being disposed on the front side;

the plurality of retainers being positioned within the at least one cutout;

the plurality of retainers comprising at least one first retainer and at least one second retainer;

the at least one first retainer comprising a base, a top side, a left side, and a right side;

the at least one second retainer comprising a base, a top side, a left side, and a right side;

the base of the at least one first retainer being terminally connected to a bottom edge of the at least one cutout;

the base of the at least one second retainer being terminally connected to the bottom edge of the at least one cutout;

the right side of the at least one first retainer being positioned adjacent to the left side of the at least one second retainer;

a base width of the at least one first retainer being greater than a top side width of the at least one first retainer;

a base width of the at least one second retainer being less than a top side width of the at least one second retainer; and the panel board capable of holding a plurality of hair pieces on the front side and on the rear side.

2. The hair extension holder as claimed in claim 1 comprising:

the at least one first retainer being V-shaped, tapering upward; and the at least one second retainer being V-shaped, tapering downward.

3. The hair extension holder as claimed in claim 1 comprising:

the base width of the at least one first retainer being equal to the top side width of the at least one second retainer; and the base width of the at least one second retainer being equal to the top side width of the at least one first retainer.

4. The hair extension holder as claimed in claim 1 comprising:

the panel board further comprising a mounting hole; and the mounting hole being disposed on the front side.

5. The hair extension holder as claimed in claim 1, wherein the panel board being made of laminated paperboard.

6. The hair extension holder as claimed in claim 1, wherein the at least one cutout being more than one cutout.

* * * * *